US005277741A

United States Patent [19]

Kramer

[11] Patent Number: 5,277,741

[45] Date of Patent: Jan. 11, 1994

[54] SEALING APPARATUS

[75] Inventor: David M. Kramer, Bartlett, Ill.

[73] Assignee: Bartlett Tool and Manufacturing, Inc., Bartlett, Ill.

[21] Appl. No.: 926,239

[22] Filed: Aug. 6, 1992

[51] Int. Cl.[5] ..... B65C 9/36

[52] U.S. Cl. ..... 156/353; 53/410; 156/64; 156/361; 156/362; 156/541; 156/542

[58] Field of Search ..... 156/64, 361, 362, 363, 156/353, 540, 541, 542; 53/410

[56] References Cited

U.S. PATENT DOCUMENTS

| | | | |
|---|---|---|---|
| 4,270,968 | 6/1981 | Dudzik et al. | 156/542 |
| 4,290,253 | 9/1981 | Domke et al. | 53/410 |
| 4,479,839 | 10/1984 | Tasma | 156/542 |
| 4,502,910 | 3/1985 | Voltmer et al. | 156/363 |
| 4,680,080 | 7/1987 | Instance | 156/363 |
| 4,773,961 | 9/1988 | Glorioso | 156/542 |
| 4,842,660 | 6/1989 | Voltmer et al. | 156/542 |
| 4,853,063 | 8/1989 | Basgil et al. | 156/542 |
| 5,028,290 | 7/1991 | Curiel | 156/542 |
| 5,188,694 | 2/1993 | Hashida et al. | 156/542 |

FOREIGN PATENT DOCUMENTS

| | | | |
|---|---|---|---|
| 112359 | 2/1968 | Norway | 156/542 |
| 1223204 | 2/1971 | United Kingdom . | |

*Primary Examiner*—David A. Simmons
*Assistant Examiner*—William J. Matney, Jr.
*Attorney, Agent, or Firm*—Dick and Harris

[57] ABSTRACT

A sealing apparatus for applying seals, such as valves, over a pressure relief passage of a container. Displaceable retention members, positioned next to a platen having an applicator surface, releasably secure one or more seals adjacent the applicator surface prior to attachment to the container. A seal attachment element moves the applicator surface toward and into a seal attachment position adjacent the container. As the applicator surface moves, the displaceable retention members release to, in turn, effectuate attachment of the seals over the pressure relief passage. A retraction element operatively attached to the platen causes return movement of the applicator surface and, in turn, return of the displaceable retention members back into a seal retaining position.

21 Claims, 3 Drawing Sheets

SEALING APPARATUS

BACKGROUND OF THE INVENTION

1. Field of the Invention

The present invention relates generally to seal applicator devices, and more particularly, to a sealing apparatus which applies seals, such as pressure relief valves, over a pressure relief passage in a container so as to allow for the release of excessive internal pressures which may accumulate therewithin.

2. Background Art

Seal applicators of the type for applying seals to containers have been available for many years. Indeed, one type of applicator has been used to apply pressure relief valves to bags and/or bag material which are to be filled with a product, such as freshly ground coffee, intended to be substantially sealed within the bag. Inasmuch as freshly ground coffee emits carbon dioxide, the bag should include a pressure relief passage for enabling the release of the internal pressure which would otherwise build up within the bag. Although merely puncturing a hole in the bag will effectively release such pressure, pressure relief valves have been applied over the hole for obvious sanitary purposes.

Typically, prior art seal applicators have applied seals/valves to bags, bag material and/or containers, through the use of a position oriented suction cup-like member which operates to release and transfer a pressure relief valve from a web of valves, carried by a carrier strip, toward and into attachment over the pressure relief passage in the bag. Such applicators position the suction cup adjacent a particular valve to be removed from the carrier strip, and then maintain the suction cup below and in operative contact with the valve as the carrier strip is being pulled toward the direction of the bag/container. As the carrier strip is being pulled, the valve will eventually release from the carrier strip where it is then intended to be secured solely to the suction cup as a result of the suction imparted thereto. The suction cup and valve are then automatically positioned adjacent the bag where the valve is to be releasably pushed into aligned attachment with the bag.

Although such prior art devices have disclosed automatic and synchronized positioning of a valve, or other type of seal, over a pressure relief passage of a bag/container, such prior art neither teaches nor suggests the forced transfer of a valve toward and into displaceable retention members for releasably securing the valve adjacent an applicator surface, and/or, wherein the retention members displaceably release the valve for attachment to the bag upon operative movement of the applicator surface—without reliance upon suction caused by a vacuum.

Furthermore, the use of a suction cup for facilitating release, and then attachment, of a valve to a bag has resulted in a great deal of wasted valves, coupled with the inadvertent production of filled bags which do not have valves attached thereto. Indeed, inasmuch as such prior art relies upon suction for maintaining the valve in position during transfer and attachment, dirt which may accumulate upon the surface of the suction cup has been known to hinder such suction—thereby resulting in valves falling off of the suction cup prior to attachment to a bag/container. Accordingly, inasmuch as conventional valves have been known to be relatively expensive, dropped and/or incorrectly aligned valves (resulting from poor suction) will not only result in a loss of money spent, but it can also result in extended "down time" associated with cleaning the suction cup, and with respect to curing the problems associated with bags which have been inadvertently filled and sealed either without pressure relief valves, and/or with valves which had been attached out of operative alignment with the pressure relief passage.

SUMMARY OF TUE INVENTION

The present invention comprises a sealing apparatus for applying seals, such as pressure relief valves, over a pressure relief passage of a container. The apparatus includes platen means for releasably supporting one or more of the seals prior to attachment over the pressure relief passage of the container. The platen means has an applicator surface wherein the one or more seals are releasably positionable adjacent thereto. Displaceable retention means are operatively associated with the platen means for releasably securing the one or more seals adjacent the applicator surface in a seal retaining position.

Seal release means are operatively associated with the platen means, and, in turn, the displaceable retention means, for facilitating the release of the one or more seals from the displaceable retention means. In addition, these release means facilitate eventual attachment of the one or more seals over the pressure relief passage of the container. Seal attachment means are operatively associated with the platen means for causing movement of the applicator surface of the platen means from the seal retaining position toward and into a seal attachment position adjacent the container. Such movement will cause displacement of the displaceable retention means toward release of the one or more seals to, in turn, effectuate attachment of the one or more seals over the one or more relief passages of the container. Retraction means are operatively attached to the platen means for causing return movement of the applicator surface of the platen means from the seal attachment position back toward and into the seal retaining position.

In the preferred embodiment of the invention, the displaceable retention means include opposed retention members carried by the platen means. The retention members each have channel means for effectuating guided securement of the one or more seals toward and into secured positioning therein adjacent the applicator surface. The channel means are operatively positioned adjacent the applicator surface of the platen means when the applicator surface is in the seal retaining position.

The displaceable retention means are pivotally associated with the platen means. The platen means may include means causing the displaceable retention means to pivot away from the longitudinal axis of the platen means upon movement of the platen means in one direction. Such movement thereby serves to effect the release of the one or more seals.

In the preferred embodiment of the invention, the platen means includes two or more side surfaces, and, the displaceable retention means comprise two opposed retention members wherein both of the retention members are positioned adjacent a corresponding one of the two or more side surfaces. Furthermore, the seal release means include at least one of the two adjacently positioned side surfaces of the platen means having cam means for causing pivotal movement of at least one of the retention members away from the platen means to effect the release of the one or more seals.

In one preferred embodiment of the invention, the two or more side surfaces of the platen means each include a proximal portion proximate the applicator surface and a distal portion. The cam means may comprise at least a section of the distal portion of at least one of the side surfaces. Accordingly, this section is positioned further away from the longitudinal axis of the applicator surface than the proximal portion—so as to facilitate the pivotal movement of the retention members upon movement of the applicator means in the one direction by the seal attachment means.

In the preferred embodiment of the invention, the seal attachment means comprises a powered advancement member operatively associated with the platen means for drivingly engaging the platen means toward and into the seal attachment position, and, the retraction means comprises a powered actuated retraction member operatively connected to the platen means for causing the return of the platen means and, in turn, the applicator surface back toward and into the seal retaining position. Although it is preferred that the power advancement member and the power actuated retraction member comprise a single pneumatically operated piston, other types of operation advancement and retraction members which are integrated with each other, or which are separate members, are also contemplated.

In another preferred embodiment of the invention, the sealing apparatus includes seal advancement means for advancing the one or more seals into operative securement with the displaceable retention means. The seal advancement means may comprise a biased arm operatively attached to a retractable power driven member—such as a pneumatically actuated piston. Furthermore, it is also contemplated that the seal advancement means be synchronized in movement with the movement of the applicator surface of the platen means.

In one embodiment of the invention, the one or more seals are carried on a carrier strip having one or more holes passing therethrough. The one or more seals are operatively and releasably carried over the holes in the carrier strip in an aligned orientation toward eventual positioning of the one or more seals adjacent the applicator surface of the platen means. In addition, seal detection means may be operatively associated with the seal advancement means for detecting whether at least one of the one or more seals is actually on the carrier strip prior to positioning of same adjacent the applicator surface.

In the preferred embodiment of the invention, the seal detection means comprises a pressure exerting element and a pressure detection switch. The pressure exerting element imparts pressure upon the carrier strip and, in turn, the one or more seals prior to positioning of the seals adjacent the applicator surface of the platen means. The pressure detection switch detects pressure only if the pressure exerting element imparts pressure through at least one of the one or more holes in the carrier strip which is not covered by one of the one or more seals. The pressure detection switch precludes advancement of the one or more seals into operative contact with the displaceable retention means upon detection of the imparted pressure.

In another preferred embodiment of the invention, the sealing apparatus includes a carrier strip take up reel operatively engaging the first end of the carrier strip so as to reduce potential interference of the carrier strip with the seal advancement means during advancement of the one or more seals into operative contact with the displaceable retention means. The carrier strip take up reel comprises a reel mounted for pivotal movement between a first predetermined position and a second predetermined position, and it also includes power means. Advancement of the one or more seals causes initiation of pivotal movement of the take up reel from the first predetermined position toward the second predetermined position. Once the second position is reached, the power means causes rotation of the take up reel—thus resulting in pivotal movement of the take up reel back toward the first predetermined position where the power means will then cease further rotation.

In one preferred embodiment of the invention, the sealing apparatus includes means for enhancing attachment of the one or more seals to the container prior to operative positioning adjacent the applicator surface. The enhancing means may comprise a pneumatically actuated liquid disbursement member for applying liquid onto at least a portion of the one or more seals—although other types of conventional enhancement means are also contemplated. In addition, it is also contemplated that the enhancing means be periodically activated in synchronization with the movement of the applicator surface of the platen means.

In the preferred embodiment of the invention, the sealing apparatus includes puncturing means operatively positioned adjacent the platen means for puncturing a pressure relief passage in the container prior to attachment of the one or more seals thereto. The puncturing means comprises a puncturing member positionable between a fully extended container puncturing orientation and a fully retracted idle orientation. Power means are operatively attached to the puncturing member for automatically driving it from the fully retracted idle orientation toward and into the fully extended container puncturing orientation and then back toward and into the fully retracted idle orientation.

The puncturing means and the platen means may be operatively attached to a pivotable structure for effectuating aligned pivotable positioning of the puncturing means, followed by aligned pivotable positioning of the platen means, with a releasably stationary container. The pivotable structure further includes power means operatively attached thereto for automatic synchronized pivoting of the puncturing means and the platen means between a container puncturing orientation and a seal attachment orientation.

BRIEF DESCRIPTION OF THE DRAWINGS

For a better understanding of the present invention, reference may be had to the accompanying drawings in which.

DETAILED DESCRIPTION OF THE DRAWINGS

Figures 1, 3, 5, 6, 7:
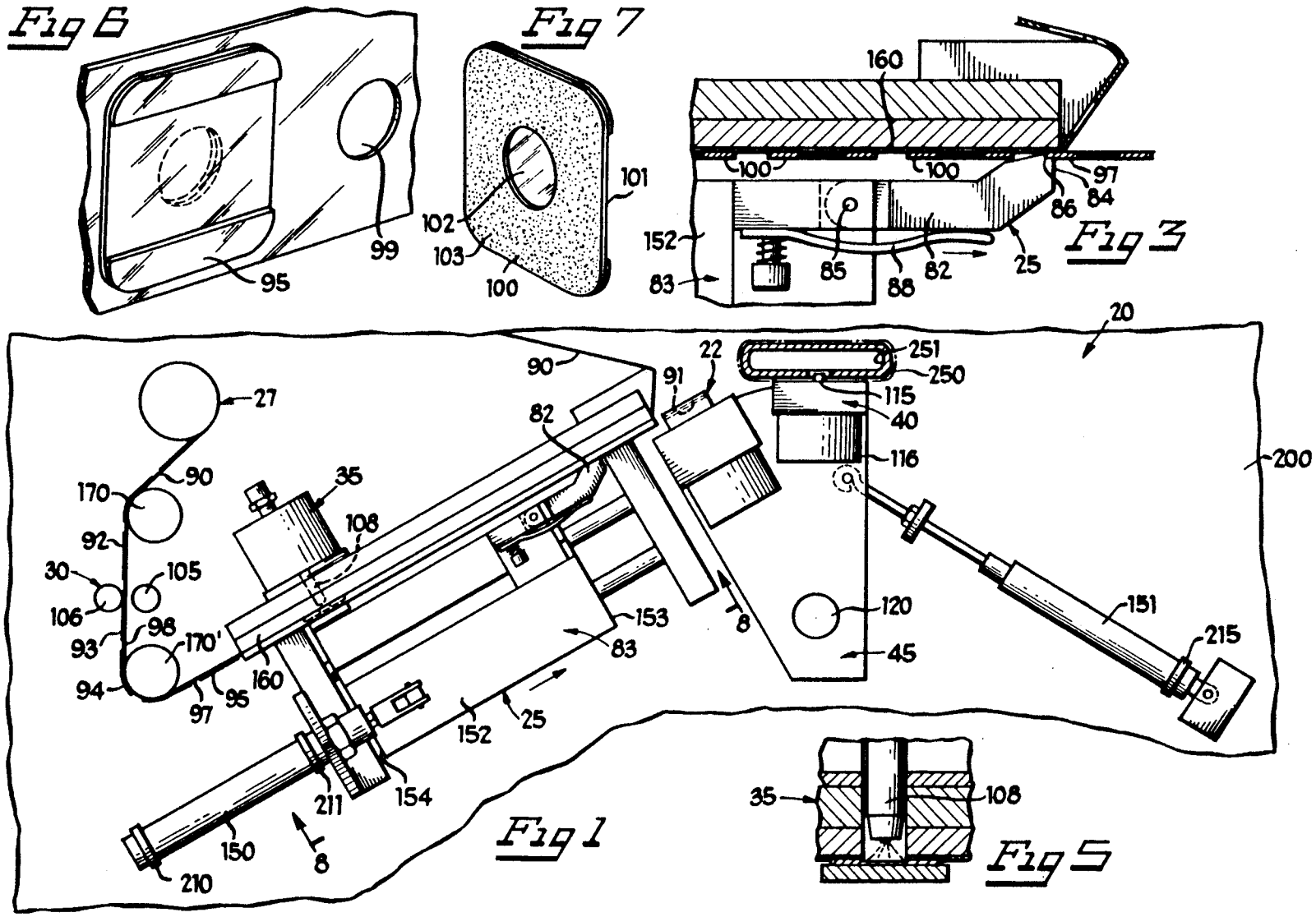
FIG. 1 is a top view of the sealing apparatus showing the positioning of the applicator surface after securement of a seal within the retention means, and, prior to attachment of the seal to the container.
FIG. 3 of the drawings is a fragmentary view of the seal advancement means.
FIG. 5 of the drawings is a fragmentary sectional view of a portion of the enhancing means.
FIG. 6 of the drawings is an enlarged fragmentary perspective view of a seal operatively carried by the carrier strip.
FIG. 7 of the drawings is an elevated perspective view of a seal.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment illustrated.

Figure 2:
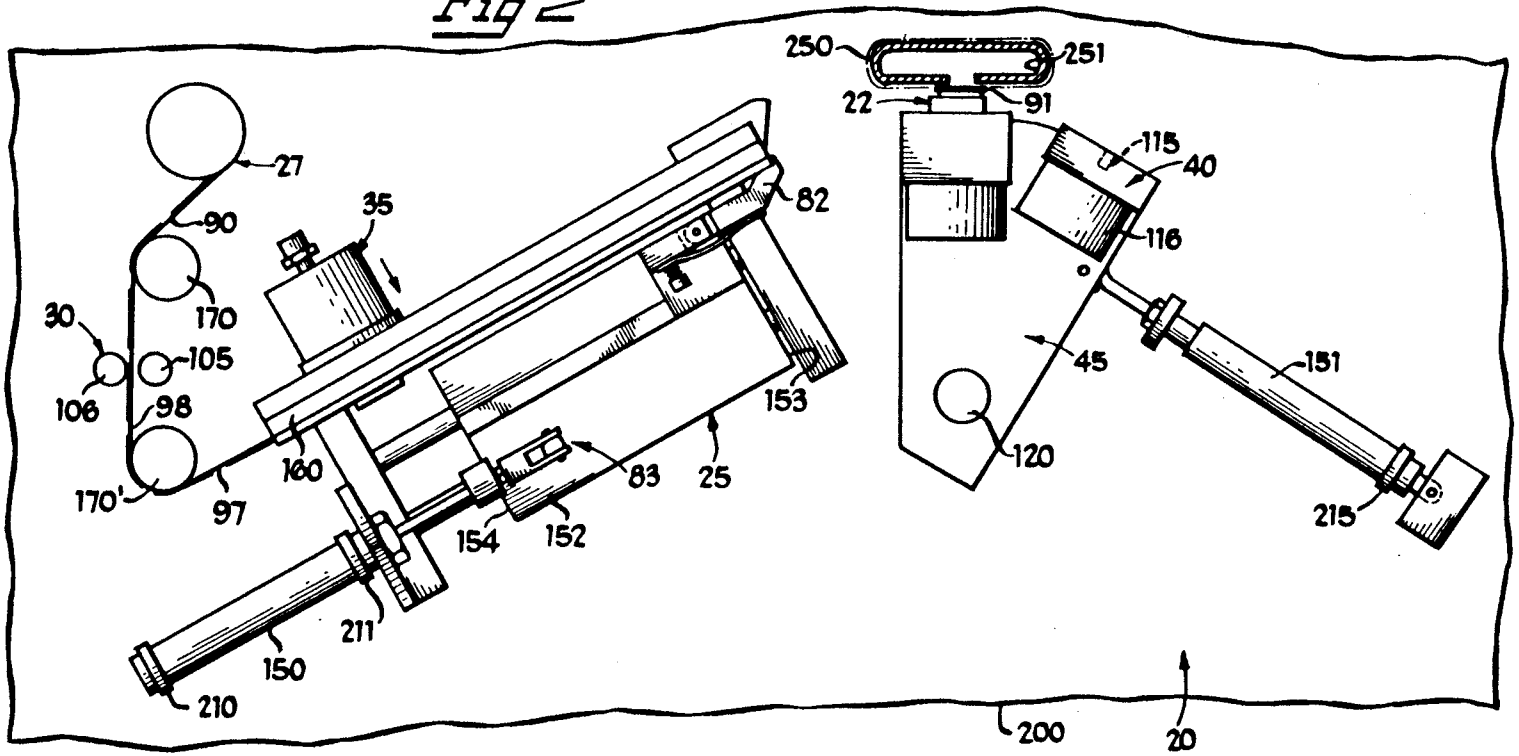
FIG. 2 of the drawings is a top view of the present sealing apparatus showing the positioning of a seal adjacent the applicator surface upon attachment of the seal to the container.
Figure 4:
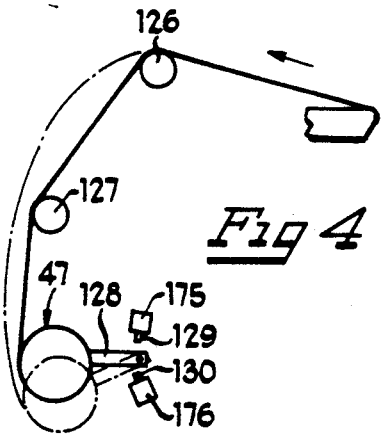
FIG. 4 of the drawings is a fragmentary view of the carrier strip take up reel.

Sealing apparatus 20 is shown in FIG. 1 and FIG. 2 as including platen retention assembly 22, seal advancement means 25, web of seals 27, seal detection means 30, enhancing means 35, puncturing means 40, pivotable structure 45, pistons 150 and 151, carrier strip guide rail 160, carriage assembly 83 and carrier strip take up reel 47 (FIG. 4). Also shown in FIG. 1 and FIG. 2 are supporting structure 200, seals, such as seal 91, and carrier strip 90 which releasably carries the seals. Such seals, which may comprise pressure relief valves for allowing the release of excessive pressure from within a container, such as a coffee bag, as well as the carrier strip, are conventionally available and known to those with ordinary skill in the art. In addition, piston 150 includes switches 210 and 211, and piston 151 includes switch 215. While these switches may comprise reed switches, any other type of conventional switch for use in association with circuitry known to those with ordinary skill in the art, which will enable synchronized automation between sealing apparatus 20 and a conventional bag making/filling machine are also contemplated for use.

Figure 9:
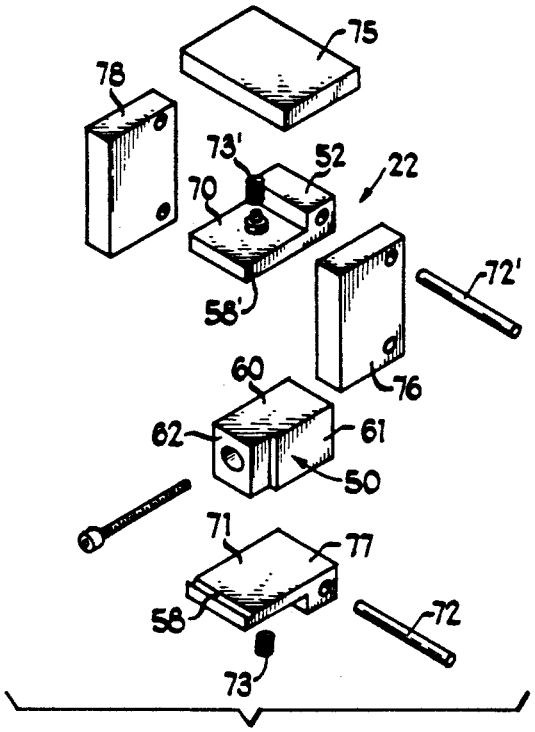
FIG. 9 of the drawings is an exploded perspective view of the platen means and the displaceable retention means.
Figure 10:
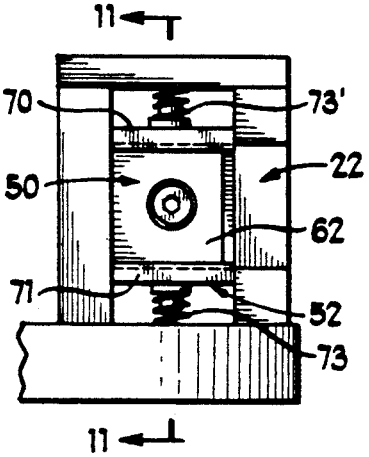
FIG. 10 of the drawings is a front fragmentary view of the applicator surface of the platen means and the retention members.
Figure 11:
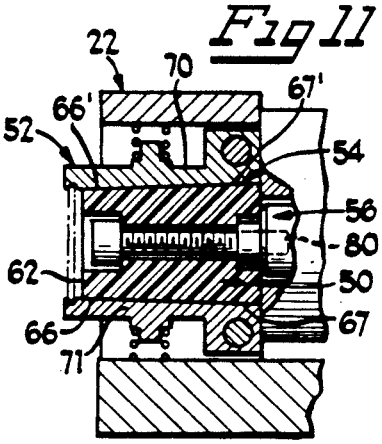
FIG. 11 of the drawings is a cross-sectional view of FIG. 10 taken generally along lines 11—11 and looking in the direction of the arrows, showing, in particular, a seal secured within the channel means of the retention members.
Figure 12:
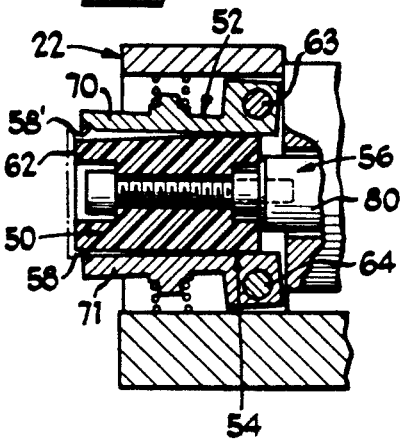
FIG. 12 of the drawings is a cross-sectional view of the platen means and the retention members, showing, in particular, the pivoted release of the retention members from the seal as well as the displaced positioning of the platen means.

Platen retention assembly 22, as shown in detail in FIGS. 9–12, includes platen means 50, displaceable retention means 52, seal release means 54 (FIG. 11 and FIG. 12), seal attachment means 56 (FIG. 11 and FIG. 12), retraction means, which is integrated with the seal release means, and assembly side walls 75, 76, 77 and 78 (FIG. 9). Platen means 50 includes a longitudinal axis (not shown), side surfaces, such as side surfaces 60 and 61 (FIG. 9), applicator surface 62, and pivoting means 63 and 64 (FIG. 12). Side surfaces 60 and 61 include proximal portion 66, 66' and a distal portion 67, 67' (FIG. 11). A section of these distal portions are positioned further away from the longitudinal axis of the platen means than are the proximal portions—thereby giving the platen means a slight wedge-like configuration. Accordingly the distal portions act like cams which force the retention members 70 and 71 (FIG. 12) apart, to in turn, release securement of a valve for eventual attachment to a bag or bag material. Although release means 54 are shown as a wedge-like cam, other types of release means, such as rounded protrusions, or even the force of operative movement of applicator surface 62 by seal attachment means 56, are also contemplated for pivoting the retention members apart.

Displaceable retention means 52, also shown in detail in FIGS. 9–12, includes two opposed retention members 70 and 71, pivoting means, which includes pivoting pins 72 and 72' (FIG. 9) and spring members 73 and 73'. Pivoting pins 72, 72' cooperate with assembly side walls 75 and 77 so as to facilitate restrained pivotable movement of the retention members. Retention members 70 and 71 include channel means 58 and 58' (FIG. 9 and FIG. 12), respectively. As will be explained, these channel means enable guided acceptance and releasable securement of a valve, or other type of seal. Although the retention members are shown as having grooved channel means, other types of channels, such as biased clamps, are also contemplated.

Seal attachment means 56 and the integrated retraction means are shown in FIGS. 11 and 12 as comprising a single pneumatically operated piston 80. This piston is advanced and retracted by conventional power means. In addition, although the attachment and retraction means are shown as a single unitary pneumatically operated piston, individual non-unitary and non-pneumatic members for retracting, and advancing, platen means 50 (FIG. 11) and, in turn, applicator surface 62 (FIG. 10), are also contemplated for use.

Seal advancement means 25 is shown in detail in FIG. 3, as comprising biased advancement arm 82 and carriage assembly 83. Carriage assembly 83, which is driven and retracted by piston 150 (FIG. 1), includes a carriage 152 (FIG. 1 and FIG. 2) having a front end 153 and a back end 154. Biased arm 82, which is operatively attached to front end 153 of the carriage and positioned adjacent carrier strip guide rail 160, includes valve driving edge 84 and pivot attachment point 85. Valve driving edge 84 includes notched portion 86 which abuts with an edge of one of the valves, such as valve 91, upon carriage 152 being driven forward (in the direction of the arrow, as shown in FIG. 1 and FIG. 3) by piston 150. Upon such abutment, biased arm 82 will push the valve into eventual releasably secured cooperation within channel means 58, 58' (FIG. 11) of the retention members. Also shown in FIG. 3, is spring loaded pressure arm 88 which applies an upward force to the biased arm so as to facilitate appropriate pressure when driving the valve and carrier strip into operative positioning, as well as which facilitates the biased arm's substantially unhindered return for engagement with the next valve to be pushed toward and into the channels of the securement members.

Figure 8:
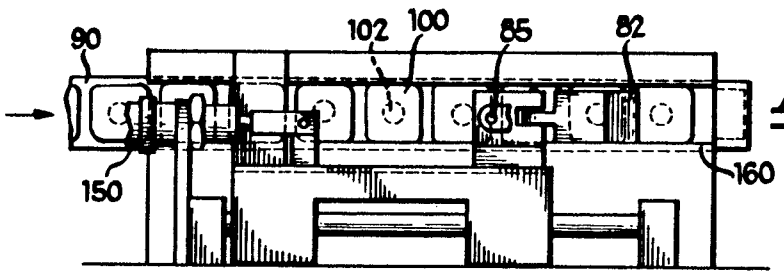
FIG. 8 of the drawings is a side fragmentary view of a plurality of seals operatively carried by the carrier strip, and operatively positioned in aligned orientation with the enhancing means and the sealing advancement means.

Web of seals 27 (FIG. 1 and FIG. 2) includes carrier strip 90 and a plurality of seals, such as pressure relief valves 92 through 95 (FIG. 1). Carrier strip 90 includes a first end (not shown), a top side 97, a bottom side 98, and plurality of holes, such as hole 99 (FIG. 6). The valves, such as valve 91 as shown in FIG. 7, which are carried by carrier strip 90, each include a container attachment side 100, a carrier attachment side 101, and a pressure relief portion 102. As can be seen, the container attachment side 100 includes adhesive 103 so as to facilitate secured attachment to a container. As shown in FIG. 3 and FIG. 8, web of seals 27 (FIG. 1) are operatively positioned within carrier strip guide rail 160 so that the container attachment side of the valves are exposed to biased arm 82. Also shown in FIGS. 1 and 2 are guide rollers 170, 170' which facilitate operative cooperation of web of seals 27 within carrier strip guide rail 160, and, seal detection means 30.

Seal detection means 30 includes pressure exerting element 105, and pressure detection switch 106. The sealed detection means detects whether a valve has been inadvertently released from carrier strip 90 prior to positioning within carrier strip guide rail 160, and, in turn, prior to securement within channels 58, 58' of retention members 70 and 71. In operation, pressure exerting element 105 exerts pressure, such as air pressure, to bottom side 98 of carrier strip 90. Inasmuch as the valves, such as valve 95 (FIG. 6), covers a corresponding hole, such as hole 99 (FIG. 6), the pressure exerted will not be detected by pressure detection switch 106. However, if a valve is missing, and accordingly the hole is exposed, the pressure exerted will be allowed to pass through the hole where it will be detected by pressure detection switch 106. Accordingly, once such pressure is detected, automatic advancement of the carrier strip will cease—thereby reducing the likelihood that containers will be filled, and substantially sealed, without a valve being applied thereto.

Enhancing means 35 is shown in FIGS. 1, 2 and 5, as including pneumatically actuated liquid disbursement member 108 (FIG. 1 and FIG. 5). This disbursement member applies a liquid, such as an oil-like substance, to the container attachment side 100 of the valves to enhance the seal between the valve and the container. Although such a liquid disbursement member is shown, other types of conventional disbursement members, as well as other types of conventional medium for enhancing such attachment is also contemplated.

Puncturing means 40 which is operatively attached adjacent platen retention assembly 22 on pivotable structure 45, is shown in FIGS. 1 and 2 as comprising puncturing member 115 and conventional power means 116. The power means effectuates positioning of puncturing member 115 between a fully extended container puncturing orientation (FIG. 1), and a fully retracted idle orientation (FIG. 2). Pivotable structure 45, which includes pivot point 120 and pivot advancement mechanism 150, enables automatic synchronized positioning of puncturing means 40 and platen retention assembly 22 between a container puncturing orientation (FIG. 1) and a valve to container attachment orientation (FIG. 2). Although pivot advancement mechanism 150 is shown as comprising an air piston, other types of conventional mechanisms for advancing and retracting a pivotable structure are also contemplated for use.

Carrier strip take up reel 47 is shown in FIG. 4 as comprising power means (not shown), which includes a motor, two switches, 175 and 176, guide rollers 126 and 127 and pivoting arm 128. Take up reel 47 is pivotably positionable between a first predetermined position 129, and a second predetermined position 130. In operation, as biased arm 82 (FIG. 3) pushes a valve, and accordingly, the carrier strip forward, the take up reel will pivot as the result of gravity, from the first position 129 toward the second position 130. Once the take up reel reaches the second position, pivoting arm 128 will contact switch 176. Accordingly, such contact with the switch will cause the motor to rotate the take up reel to, in turn, take up the slack in carrier strip 90. Such rotation will continue until pivoting arm 128 is forced against second switch 175 located at the first predetermined position 129 wherein further rotation will cease. Although the preferred take up reel relies upon gravity and conventional electro-mechanical devices and circuitry, other take up reels, such as purely electro-mechanical are also contemplated.

Actual operation of seal apparatus 20 will now be explained. Initially, it is to be understood that web of seals/valves 27 must be operatively threaded adjacent and past carrier strip guide rail 160 and then operatively attached to take up reel 47. Furthermore, it will also be understood that sealing apparatus 20 is to be operatively positioned adjacent bag material 250 which is operatively wrapped around a conventional C-shaped bag tube 251 (FIG. 1 and FIG. 2)—although other types of conventional bag tubes and/or bag making and/or filling apparatuses are also contemplated for use in association with sealing apparatus 20.

In accordance with the above, sealing apparatus 20 is ready for operation when platen retention assembly 22 is pivotally positioned adjacent carrier strip guide rail 160, and, when carriage 151 is in a fully retracted position (FIG. 1). Accordingly, when such an orientation is obtained, a seal, such as pressure relief valve 91, will be operatively secured within channel means 205 and 206 (FIG. 11) of displaceable retention means through forced positioning by biased arm 82 and extended positioning of carriage means 83 by piston 150. At the same time, another seal, such as pressure relief valve 92, will have been operatively aligned adjacent enhancing means 35. Furthermore, puncturing member 115 will have created a pressure relief passage in the bag material.

After the bag material has been punctured, switch 210 on piston 150 will cause piston 151 to retract which will, in turn, position platen retention assembly adjacent the pressure relief passage in the bag material (FIG. 2). Once piston 151 is fully retracted, switch 215 will close. As a result, enhancing means 35 will force disbursement member 108 (FIG. 5) to move in the direction of the arrow (FIG. 2) so as to release oil, or other enhancing medium, through the hole in the carrier strip and accordingly onto a portion of the bag contact side of the valve (FIG. 5). At approximately the same time, piston 80 of seal attachment means 56 (FIG. 11), will force applicator surface 62 to move toward the bag/container (FIG. 12) and into a valve attachment orientation (FIG. 2). As the platen means, and in turn, the applicator surface are moved toward the bag, such movement will cause displaceable retention members 70, 71 to pivot away from the longitudinal axis of the platen, which in turn will releases the valve from channel means 58, 58' (FIG. 12). Accordingly, such pivotal release will facilitate operative attachment of the valve to be bag. After a valve has been attached to the bag material, piston 80 retracts platen means 50 causing applicator surface 62 and retention members 70 and 71 back into position for secured acceptance of another valve.

After a predetermined period of time the process will repeat wherein switch 211 will cause piston 150 to extend. Accordingly, carriage 152 will force notched portion 86 of biased arm 82 into abutment with another valve. Upon such abutment, piston 150 will cause the carriage and biased arm to push the valve into the channel means of the retention members for releasable securement therewith. At the same time, the excess carrier strip 90 (FIG. 1 and FIG. 4) will be pushed into operative cooperation with the take up reel 47.

Although a specific sequence of operation has been explained, it should be understood that other sequences are also contemplated through reconfiguration of the switches and related circuitry.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A sealing apparatus for applying seals of the type having side edges over a pressure relief passage of a container, said apparatus comprising:

platen means for releasably supporting one or more of the seals prior to attachment over a pressure relief passage of a container, said platen means having an applicator surface wherein the one or more seals are releasably positionable adjacent said applicator surface;

displaceable retention means operatively associated with said platen means for releasably securing the one or more seals adjacent said applicator surface of said platen means in a seal retaining position;

said displaceable retention means including opposed retention members having channel means for slideably receiving and supporting a portion of at least two of said side edges of the one or more seals;

seal release means operatively associated with said platen means, and, in turn, said displaceable retention means, for facilitating the release of the one or more seals from said displaceable retention means and, in turn, to facilitate eventual attachment of the one or more seals over the pressure relief passage of the container;

seal attachment means operatively associated with said platen means for causing movement of said applicator surface of said platen means from said seal retaining position toward and into a seal attachment position adjacent the container and for causing displacement of said displaceable retention means toward release of the one or more seals from said channel means to, in turn, effectuate attachment of the one or more seals over the one or more relief passages of the container; and retraction means operatively attached to said platen means for causing return movement of said applicator surface of said platen means from said seal attachment position back toward and into said seal retaining position.

2. The invention according to claim 1 in which said opposed retention members are carried by said platen means, said retention members each including said channel means for effectuating slideable securement and support of one or more seals toward and into secured positioning therein adjacent said applicator surface, said channel means being operatively positioned adjacent said applicator surface of said platen means when said applicator surface is in said seal retaining position.

3. The invention according to claim 1 wherein:

said platen means has a longitudinal axis;

said displaceable retention means are pivotally associated with said platen means, said platen means including means causing said displaceable retention means to pivot away from said longitudinal axis of said platen means upon movement of said platen means in one direction to effect the release of the one or more seals.

4. The invention according to claim 3 in which:

the platen means includes two or more side surfaces;

said displaceable retention means comprises two of said opposed retention members, each positioned adjacent a corresponding one of said two or more side surfaces;

said seal release means including at least one of said two or more side surfaces adjacent said retention members having cam means for causing pivotal movement of at least one of said retention members away from said platen means to effect the release of the one or more seals.

5. The invention according to claim 4 in which:

said two or more side surfaces of said platen means each having a proximal portion proximate said applicator surface and a distal portion;

said cam means comprises at least a section of the distal portion of at least one of said side surfaces, said section being positioned further away from the longitudinal axis of said applicator surface than the proximal portion so as to facilitate said pivotal movement of said retention members upon movement of said applicator means in said one direction by said seal attachment means.

6. The invention according to claim 1 in which the seal attachment means comprises a powered advancement member operatively associated with said platen means for drivingly engaging said platen means toward and into said seal attachment position.

7. The invention according to claim 1 in which said retraction means comprises a power actuated retraction member operatively connected to said platen means for causing the return of said platen means and, in turn, said applicator surface back toward and into said seal retaining position.

8. The invention according to claim 7 wherein:

the seal attachment means comprises a powered advancement member operatively associated with said platen means for drivingly engaging said platen means toward and into said seal attachment position; and said power advancement member and said power actuated retraction member comprise a single pneumatically operated piston.

9. The invention according to claim 1 in which the sealing apparatus further includes seal advancement means for operatively advancing the one or more seals into operative securement with said displaceable retention means.

10. The invention according to claim 9 in which the seal advancement means comprises a biased arm operatively attached to a retractable power driven member.

11. The invention according to claim 10 in which the power driven member comprises a pneumatically actuated piston.

12. The invention according to claim 9 in which the seal advancement means is synchronized in movement with the movement of said applicator surface of said platen means.

13. The invention according to claim 9 in which:

the one or more seals are carried on a carrier strip having one or more holes passing therethrough, the one or more seals being operatively and releasably carried over the holes in the carrier strip in an aligned orientation toward eventual positioning of the one or more seals adjacent said applicator surface of said platen means, said sealing apparatus further includes seal detection means operatively associated with said seal advancement means for detecting whether at least one of said one or more seals is actually on the carrier strip prior to positioning of same adjacent said applicator surface.

14. The invention according to claim 13 in which said seal detection means comprises a pressure exerting element and a pressure detection switch, said pressure exerting element imparting pressure upon the carrier strip and, in turn, the one or more seals prior to positioning of the seals adjacent said applicator surface of said platen means, said pressure detection switch detecting pressure only if the pressure exerting element imparts pressure through at least one of the one or more holes in the carrier strip which is not covered by one of the one or more seals, said pressure detection switch precluding advancement of the one or more seals into operative contact with said displaceable retention means upon detection of the imparted pressure.

15. The invention according to claim 9 in which:

the one or more seals are releasably carried on a carrier strip having a first end, the one or more seals being carried in an aligned orientation toward eventual securement with said displaceable retention means and, in turn, adjacent said applicator surface of said platen means, said sealing apparatus further includes a carrier strip take up reel operatively engaging to the first end of the carrier strip to reduce potential interference of the carrier strip with said seal advancement means during advancement of the one or more seals into operative contact with said displaceable retention means, said carrier strip take up reel comprising a reel mounted for pivotal movement between a first predetermined position and a second predetermined position and power means, advancement of the one or more seals initiating movement of the take up reel from the first predetermined position toward the second predetermined position, said power means causing rotation of the take up reel upon the take up reel pivoting to the second predetermined position wherein said rotation causes the take up reel to pivot back toward the first predetermined position, said power means ceasing rotation of the take up reel after the take up reel has pivoted back to the first predetermined position.

16. The sealing apparatus according to claim 1 in which the invention further includes means for enhancing attachment of the one or more seals to the container prior to operative positioning of the one or more seals adjacent said applicator surface.

17. The invention according to claim 16 in which said enhancing means comprises a pneumatically actuated liquid disbursement member for applying liquid onto at least a portion of the one or more seals.

18. The invention according to claim 16 in which said enhancing means is periodically activated in synchronization with the movement of said applicator surface of said platen means.

19. The sealing apparatus according to claim 1 in which the invention further includes puncturing means operatively positioned adjacent said platen means for puncturing a pressure relief passage in the container prior to attachment of said one or more seals to the container, said puncturing means comprises a puncturing member positionable between a fully extended container puncturing orientation and a fully retracted idle orientation; and power means operatively attached to said puncturing member for automatically driving said puncturing member from the fully retracted idle orientation toward and into the fully extended container puncturing orientation and then back toward and into the fully retracted idle orientation.

20. The invention according to claim 19 in which said puncturing means and said platen means are operatively attached to a pivotable structure for effectuating aligned pivotable positioning of said puncturing means followed by aligned pivotable positioning of said platen means with a releasably stationary container, said pivotable structure further includes power means operatively attached thereto for automatic synchronized pivoting of said puncturing means and said platen means between a container puncturing orientation and a seal attachment orientation.

21. The invention according to claim 1 in which the one or more seals comprise pressure relief valves.

* * * * *

UNITED STATES PATENT AND TRADEMARK OFFICE

CERTIFICATE OF CORRECTION

PATENT NO. : 5,277,741

DATED : January 11, 1994

INVENTOR(S) : David M. Kramer

It is certified that error appears in the above-indentified patent and that said Letters Patent is hereby corrected as shown below:

| | |
|---|---|
| Col. 2 line 10 | Delete "TUE" and insert instead -- THE --. |
| Col. 9 line 62 | After "of" insert "the". |

Signed and Sealed this

Twenty-eighth Day of June, 1994

*Attest:*

*Attesting Officer*

Bruce Lehman

BRUCE LEHMAN

*Commissioner of Patents and Trademarks*